US011783786B2

(12) United States Patent
Gao

(10) Patent No.: US 11,783,786 B2
(45) Date of Patent: Oct. 10, 2023

(54) ELECTRONIC APPARATUS

(71) Applicant: Lenovo (Beijing) Limited, Beijing (CN)

(72) Inventor: Ming Gao, Beijing (CN)

(73) Assignee: LENOVO (BEIJING) LIMITED, Beijing (CN)

( * ) Notice: Subject to any disclaimer, the term of this patent is extended or adjusted under 35 U.S.C. 154(b) by 0 days.

(21) Appl. No.: 17/550,282

(22) Filed: Dec. 14, 2021

(65) Prior Publication Data

US 2022/0310024 A1 Sep. 29, 2022

(30) Foreign Application Priority Data

Mar. 29, 2021 (CN) ..... 202110336345.4

(51) Int. Cl.
*G09G 3/34* (2006.01)
*G09G 5/10* (2006.01)

(52) U.S. Cl.
CPC ..... *G09G 3/3406* (2013.01); *G09G 5/10* (2013.01); *G09G 2330/021* (2013.01); *G09G 2370/20* (2013.01); *G09G 2370/22* (2013.01)

(58) Field of Classification Search
None
See application file for complete search history.

(56) References Cited

U.S. PATENT DOCUMENTS

2018/0336846 A1* 11/2018 Lee et al. ..... G06F 13/42
2021/0271302 A1* 9/2021 Hsia ..... G06F 13/42

FOREIGN PATENT DOCUMENTS

CN 111459435 A 7/2020
CN 212364819 U 1/2021

* cited by examiner

*Primary Examiner* — Andre L Matthews
(74) *Attorney, Agent, or Firm* — ANOVA LAW GROUP, PLLC

(57) ABSTRACT

An apparatus includes a display device, a switch assembly configured to switch a signal source of a display signal for the display device, a processor connected to the switch assembly and configured to provide signal to the display device through the switch assembly in a first mode, and a controller connected to the switch assembly and configured to provide the display signal to the display device through the switch assembly in a second mode.

15 Claims, 5 Drawing Sheets

ELECTRONIC APPARATUS

CROSS-REFERENCE TO RELATED APPLICATION

This application claims priority to Chinese Patent Application No. 202110336345.4, filed on Mar. 29, 2021, the entire content of which is incorporated herein by reference.

TECHNICAL FIELD

The present disclosure generally relates to the apparatus control technical field and, more particularly, to a first apparatus.

BACKGROUND

The screen size of tablet computers is getting bigger and bigger, and even close to the screen size of portable monitors. For example, the screen of some tablet computers has reached 13 or 14 inches. Based on this feature, some current product designs combine the functions of tablet computers and monitors, so that the tablet computer may support the display mode. However, the current tablet computer that supports the display mode has high power consumption when running in the tablet mode (that is, the host mode) with a bright screen, which is difficult to meet the low power consumption requirements of the product.

SUMMARY

Embodiments of the present disclosure provide an apparatus. The apparatus includes a display device, a switch assembly configured to switch a signal source of a display signal for the display device, a processor connected to the switch assembly and configured to provide the signal to the display device through the switch assembly in a first mode, and a controller connected to the switch assembly and configured to provide display signal to the display device through the switch assembly in a second mode.

DETAILED DESCRIPTION OF THE EMBODIMENTS

The technical solutions of the present disclosure are described clearly according to the accompanying drawings. The described embodiments are only some embodiments not all the embodiments of the present disclosure. Based on the embodiments of the disclosure, all other embodiments obtained by those of ordinary skill in the art without any creative work are within the scope of the present disclosure.

Figure 1:
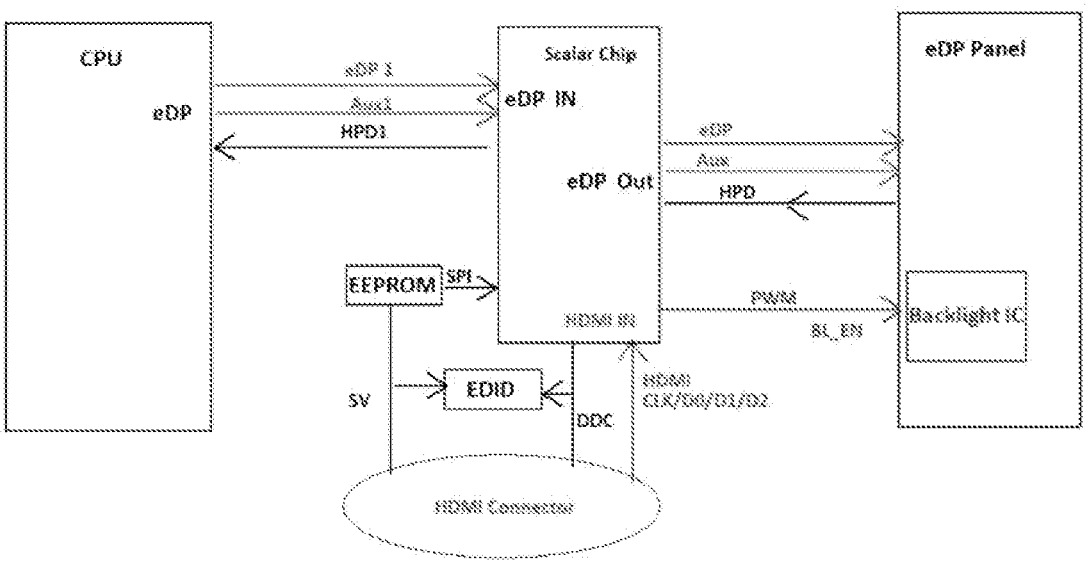
FIG. 1 illustrates a schematic diagram showing a circuit architecture and its signal flow diagram for display control of an apparatus in a serial manner.

Some tablet computers have combined the functions of the computer and the monitor to achieve a two-in-one function. The combination not only can operate in a tablet mode (that is, host mode) but also support a monitor mode. A main control chip (Scalar Chip) of the monitor/display screen can be configured as the screen control chip of an entire system, and the display screen of the tablet computer can be controlled in a serial manner. As shown in FIG. 1, a central processing unit (CPU) of the tablet computer is connected to a display drive assembly of the display screen through the main control chip of the display screen. As such, when the table computer is working in tablet mode, the Scalar Chip transmits the display signal provided by the CPU to a display drive assembly to drive the display screen to display information. When the tablet computer is working in the display mode, the Scalar Chip transmits the signal provided by an external apparatus (for example, a notebook) to the display drive assembly to drive the display screen to display information. As such, no matter what mode the tablet computer is working in, the Scalar Chip always works, which may cause the tablet computer in the tablet mode to consume a very large amount of operation power when the screen is on (the power consumption of Scalar Chip is generally above 2 W).

To solve the above-described problem, the present disclosure provides a first apparatus. The first apparatus can be, but is not limited to, a tablet computer, an all-in-one computer, or a note book that not only can support the regular host mode, but also can support the display mode.

Figure 2:
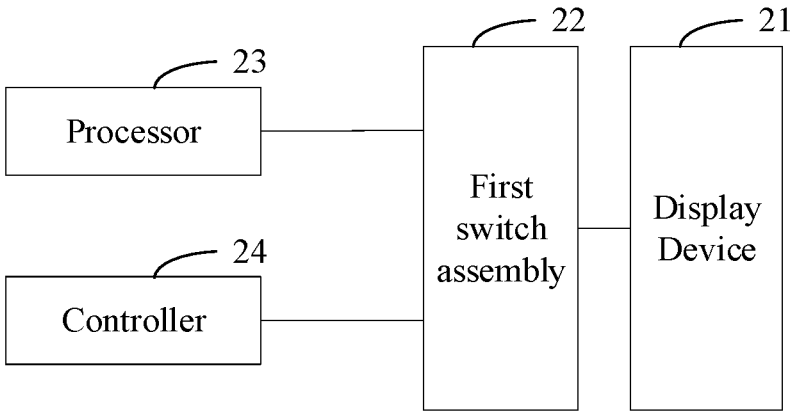
FIG. 2 illustrates a schematic structural diagram of a first apparatus according to some embodiments of the present disclosure.

FIG. 2 shows a schematic structural diagram of a first apparatus. In some embodiments, the first apparatus of the present disclosure at least includes a display device 21, a first switch assembly 22, a processor 23, and a controller 24.

In some embodiments, the display device 21 may include but is not limited to a liquid crystal display (LCD), an organic light-emitting diode (OLED), or any other types of monitor/display screen, which may include or not include a touch control function, which is not limited here.

In an implementation, the display device 21 may be implemented as including a touch function.

The first switch assembly 22 is configured to switch a signal source of a display signal for the display device 21.

The processor 23 is connected to the first switch assembly 22. The processor 23 is configured to provide the display signal to the display device 21 through the first switch assembly 22 in a first mode.

The controller 24 is connected to the first switch assembly 22. The controller 24 is configured to provide the display signal to the display device 21 through the first switch assembly 22 in a second mode.

In some embodiments, the controller 24 provides a display signal to the display device 21 by obtaining a display signal of an externally connected second apparatus in the second mode. The power consumption of the controller 24 in the first mode is lower than that in the second mode, and the power consumption of the processor 23 in the first mode is higher than the power consumption in the second mode.

In some embodiments, when the first apparatus is running in different modes, the signal source of the display signal of the display device 21 is different. When the first apparatus is running in the first mode, the processor 23 of the first apparatus is configured as the signal source of the display signal for the display device 21. When the first apparatus is running in the second mode, the controller 24 of the first apparatus is configured as the signal source of the display signal for the display device 21 (further, in this scenario, the signal source of the display signal of the display device 21 is essentially an external second apparatus connected to the controller 24, such as an external notebook).

In some embodiments, the above-described first mode is the host mode of the first apparatus, which, when the first apparatus is a tablet computer, is also referred to as a tablet mode. The second mode is a display mode. In the display mode, the first apparatus may be configured as an extended display of the second apparatus (such as a notebook, etc.) by connecting the first apparatus to the second apparatus.

In some embodiments, the processor 23 may be the CPU of the first apparatus, and the controller 24 may be the Scalar chip of the display device 21.

To solve the above technical problems and reduce the operation power consumption of the apparatus, the present disclosure provides a parallel manner for display control of the display screen of the apparatus. The first switch assembly 22 is connected to the display device 21, the processor 23 and the controller 24 are added to the first apparatus, respectively. The processor 23 and the controller 24 are connected to the first switch assembly 22 in a parallel manner, so as to perform a display control on the display device 21 through the first switch assembly 22. When the first apparatus is in different modes, the first switch assembly 22 realize the selection of a display signal source (processor or controller) of the display device 21 by switching.

The first switch assembly 22 can be, but is not limit to, an embedded display port (eDP) MUX switch chip.

Figure 3:
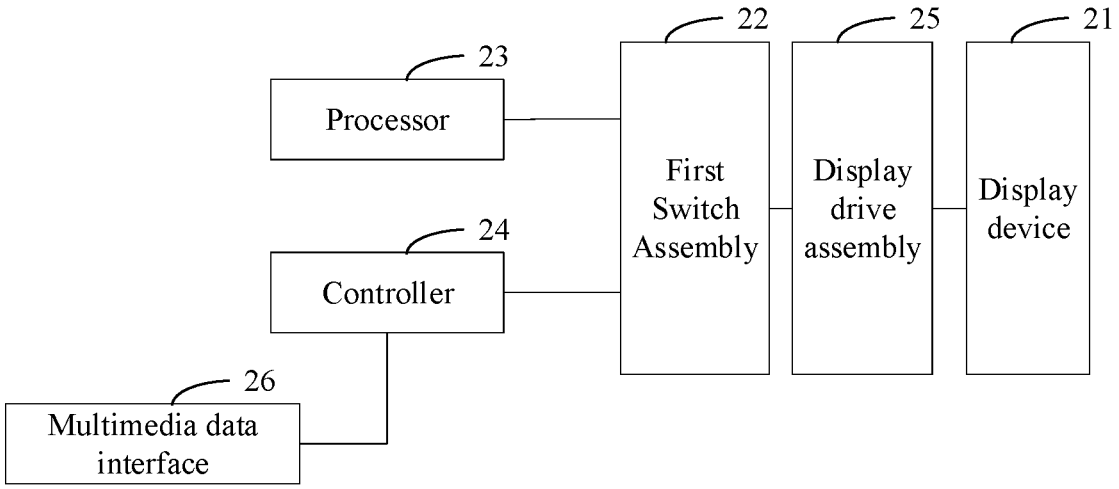
FIG. 3 illustrates another schematic structural diagram of the first apparatus according to some embodiments of the present disclosure.

Further, in some embodiments, the first apparatus also includes a display drive assembly 25 for driving the display device 21 to display information. In some embodiments, the first switch assembly 22 being connected to the display device 21 refers to that the first switch assembly 22 is connected to the display drive assembly 25 of and the display device 21. In addition, to support the first apparatus to operate in the display mode, the first apparatus further includes a multimedia data interface 26, as shown in FIG. 3. The multimedia data interface 26 can be a High Definition Multimedia Interface (HDMI) or a Display Port (DP) interface, which is configured for the transmission of multimedia data signals such as audio and video between the first apparatus and the second apparatus.

When the second apparatus is connected to the first apparatus through the multimedia data interface 26, the processor 23 of the first apparatus detects access information indicating that the second apparatus is connected to the multimedia data interface 26, for example, the 5V power signal at the HDMI interface (generated based on the power supplied by the second apparatus to the HDMI interface when the second apparatus is connected to the HDMI interface of the first apparatus) is detected, and, based on the access information, the first apparatus is controlled to switch to the display mode as the second mode. At the same time, in response to the first apparatus switching into the display mode, the first switch assembly 22 turns on the electrical connection between the controller 24 and the display drive assembly 25 of the display device 21, and disconnects electrical connection between the processor 23 and the display drive assembly 25. At this time, the controller 24 is configured as the display signal source of the display device 21 of the first apparatus. In some embodiments, the controller 24 obtains the display signal of the external second apparatus through the multimedia data interface 26 and converts the display signal to a signal format of the display device 21 based on a protocol, and then the converted display signal is transmitted to the display drive assembly 25 to drive the display device 21 for information display.

In some embodiments, the display signal of the second apparatus obtained by the controller 24 may be a display signal of images, characters, etc., or a video signal separated from the audio and video signals transmitted by the second apparatus through the multimedia data interface 26.

When the first apparatus switches into the display mode, the processor 23 switches from a normal high power consumption state to a low power consumption state to save power consumption of the apparatus. In some embodiments, the low power consumption state may be but not limited to a sleep or hibernation state.

Figure 4:
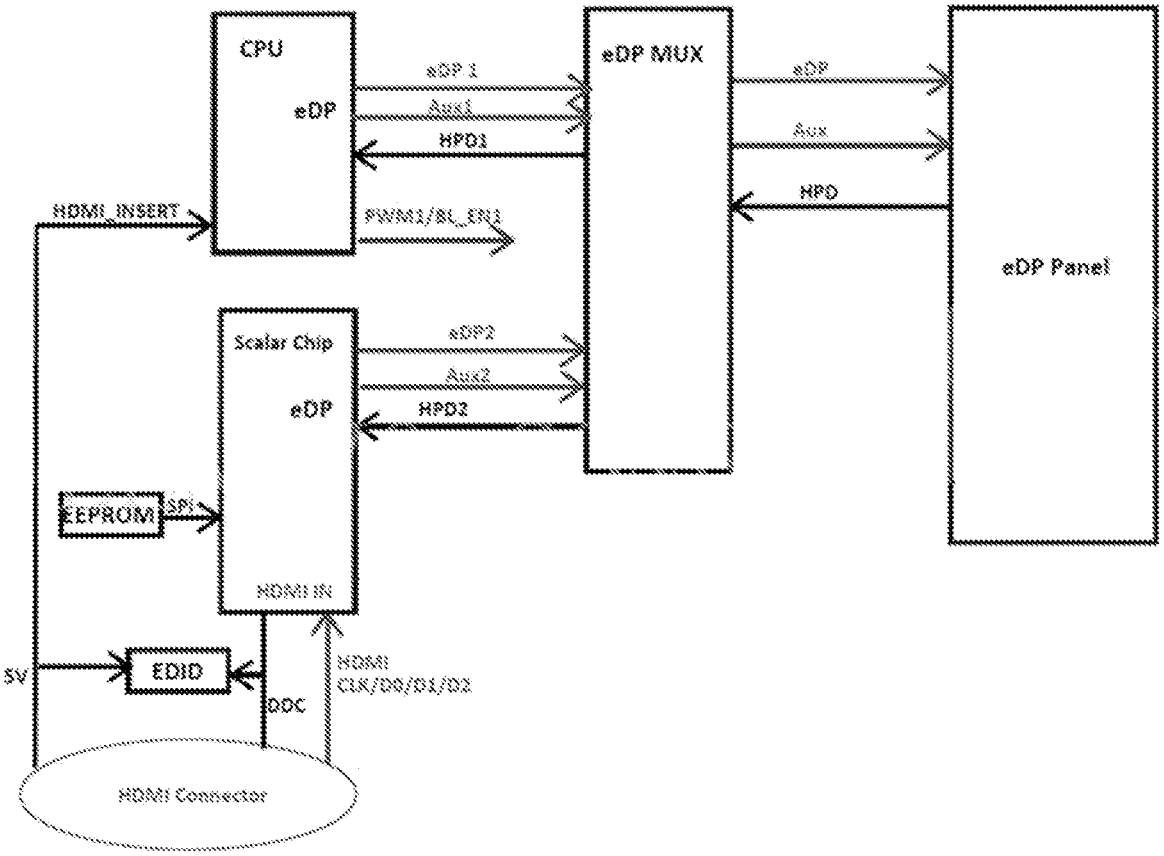
FIG. 4 illustrates a schematic diagram showing a circuit architecture and its signal flow diagram for display control of an apparatus in a parallel manner according to some embodiments of the present disclosure.

In some embodiments, take the multimedia data interface 26 being an HDMI and the first apparatus being a tablet computer as an example, as shown in FIG. 4, the first switch assembly (that is, eDP MUX) is added to the tablet computer. The CPU and the Scalar Chip are connected to the eDP MUX in the parallel manner. When the tablet computer is connected to the notebook through the HDMI interface to be configured as an extended display screen of the notebook, the tablet computer switches from the display mode to the tablet mode, and the Scalar Chip is electrically connected to the display drive assembly of the eDP panel through the eDP MUX, and the electrical connection between the CPU and the display drive component is disconnected and enter a low-power state such as sleep. As such, the notebook captures an extended display identification data (EDID) of a tablet through the direct digital control (DDC) channel of the HDMI interface, and the HDMI signal is transmitted to the tablet computer through the HDMI interface. Then, the Scalar Chip of the tablet computer receives the HDMI signal and converts it to a form of an eDP signal to obtain the eDP signal, as the eDP2 in FIG. 4. Then, the eDP signal is transmitted to the display driving assembly of the eDP panel of the tablet computer through the eDP MUX, so that the display driving assembly may drive the eDP panel to display information based on the received signal.

On the other hand, when the processor 23 detects the disconnection information indicating that the second apparatus is disconnected from the multimedia data interface 26, for example, when the HDMI signal line is unplugged, the 5V power signal of the HDMI interface disappears and an interrupt is triggered. After the processor 23 detects the interrupt, the first apparatus is controlled to switch from the display mode (second mode) to the host mode (first mode). At this time, the processor 23 wakes up from the low power consumption state and enters the regular high power consumption state. In addition, in response to the first apparatus entering the host mode, the first switch assembly 22 turns on the electrical connection between the processor 23 and the display drive assembly 25 and disconnects the electrical connection between the controller 24 and the display drive assembly 25. At this time, the processor 23 is configured as the display signal source of the display device 21 of the first apparatus to provide the display signal to the display driving assembly 25 of the display device 21 through the first switch assembly 22.

In some embodiments, as shown in FIG. 4. In the host mode, the CPU of the tablet computer provides an eDP signal, such as eDP1 shown in FIG. 4. The signal is transmitted to the display driving assembly of the eDP panel through the switch eDP MUX, as such, the display driving assembly drives the eDP panel to display information based on the eDP signal.

In the host mode, since the controller 24 does not need to participate in the display control of the display device 21, the controller 24, such as the Scalar Chip shown in FIG. 4, may be switched into a low power consumption state when entering the host mode. The low power consumption state of the controller 24 in the host mode can be, but is not limited to, any of sleep, hibernation or complete power-off.

The power consumption of the first switch assembly 22 such as the eDP MUX switch chip is relatively small, and the power consumption of the eDP MUX is generally less than or equal to 0.4 W, while the power consumption of the controller 24 such as the Scalar Chip is generally above 2 W. In the present disclosure, a first switch assembly such as eDP MUX is added to the first apparatus, and the controller 24 is switched into a low power consumption state or even completely powered off in the host mode, as such, the power consumption when the apparatus runs in the host mode can be significantly reduced.

In some embodiments, the first apparatus provided by the present disclosure may be configured to work in the first mode (such as the host mode) and the second mode (such as the display mode). For the first apparatus capable of working in the above-described two modes, the first switch assembly for switching the display signal source of the display device of the first apparatus is added to the first apparatus, so that the display control path of the display device of the first apparatus in the first mode and the second mode is isolated into two independent systems, thus, in any mode, the display signal source assembly in the other mode may be controlled to switch to a low power consumption state or even completely powered off to save power consumption. For example, when the first apparatus is working in the first mode, the controller is turned off for providing display signals to the display device of the first apparatus in the second mode, leaving only the processor in working state, etc., which may effectively reduce the brightness of electronic apparatus that support the display mode, thereby meeting the low power consumption requirements of the product better.

Figure 5:
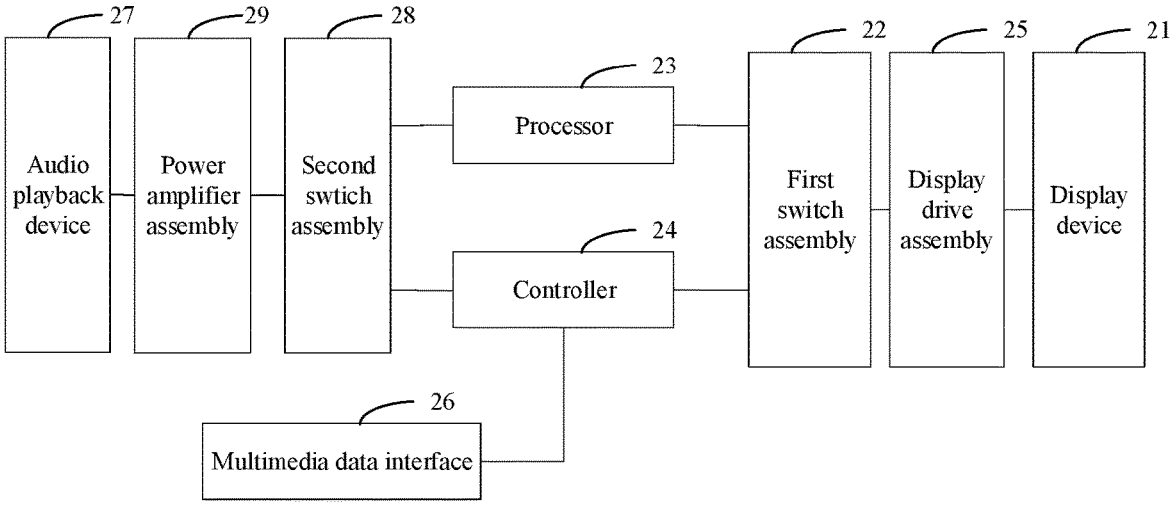
FIG. 5 illustrates another schematic structural diagram of the first apparatus according to some embodiments of the present disclosure.

In some embodiments, as shown in FIG. 5, the first apparatus provided in the present disclosure further includes an audio playback device 27 and a second switch assembly 28.

The audio playback device 27 may include a speaker, and the second switch assembly may be, but is not limited to, an I2S (Inter-IC Sound, integrated circuit built-in audio bus) MUX switch chip.

The second switch assembly 28 is connected to the audio playback device 27, the processor 23, and the controller 24. In some embodiments, the processor 23 and the controller 24 are connected to the second switch assembly 28 in the parallel manner and perform audio playback control on the audio playback device through the second switch assembly 28.

In some embodiments, the second switch assembly 28 may be configured to, in response to the first apparatus entering the first mode, turn on the electrical connection between the processor 23 and the audio playback device 27, and disconnect the electrical connection between the controller 24 and the audio playback device 27.

The second switch assembly 28 may further be configured to, in response to the first apparatus entering the second mode, turn on the electrical connection between the controller 24 and the audio playback device 27, and disconnect the electrical connection between the processor 23 and the audio playback device 27.

Similar to the display control of the display device, the second switch assembly 28 is configured to switch the signal source of the audio signal of the audio playback device 27 when the first apparatus performs mode switching. In some embodiments, in the first mode, that is, the host mode, the processor 23, such as a CPU, serves as the audio signal source of the audio playback device 27. In the second mode, that is, the display mode, the second switch assembly 28 switches the audio signal source of the audio playback device 27 to the controller 24, such as a Scalar Chip, is switched as the audio signal source of the audio playback device 27 through the second switch assembly 28.

In some embodiments, as shown in FIG. 5, the first apparatus further includes a power amplifier assembly 29. The power amplifier assembly 29 is connected between the audio playback device 27 and the second switch assembly 28.

The power amplifier assembly 29 is configured to perform digital-to-analog conversion and power amplification processing on the obtained digital audio signal and transmit the amplified analog audio signal to the audio playback device 27 for playback.

In some embodiments, the processor 23 may be further configured to obtain a digital audio signal in the first mode, that is, the host mode, and transmit the digital audio signal to the power amplifier assembly 29 through the second switch assembly 28.

The controller 24 may be further configured to obtain a digital audio signal in the second mode and transmit the digital audio signal to the power amplifier assembly 29 through the second switch assembly 28. In some embodiments, in the display mode, the controller 24 obtains the multimedia data signal transmitted by the external second apparatus through the multimedia data interface 26, separates the display signal and the digital audio signal from the multimedia data signal, and converts the separated display signal to the format required by the display device. Then, the converted display signal is provided to the display drive assembly 25 to drive the display device 21 for information display. At the same time, the separated digital audio signal is provided to the power amplifier assembly 29 for digital-to-analog conversion and amplification, so as to perform audio playback at the audio playback device 27.

Figure 6:
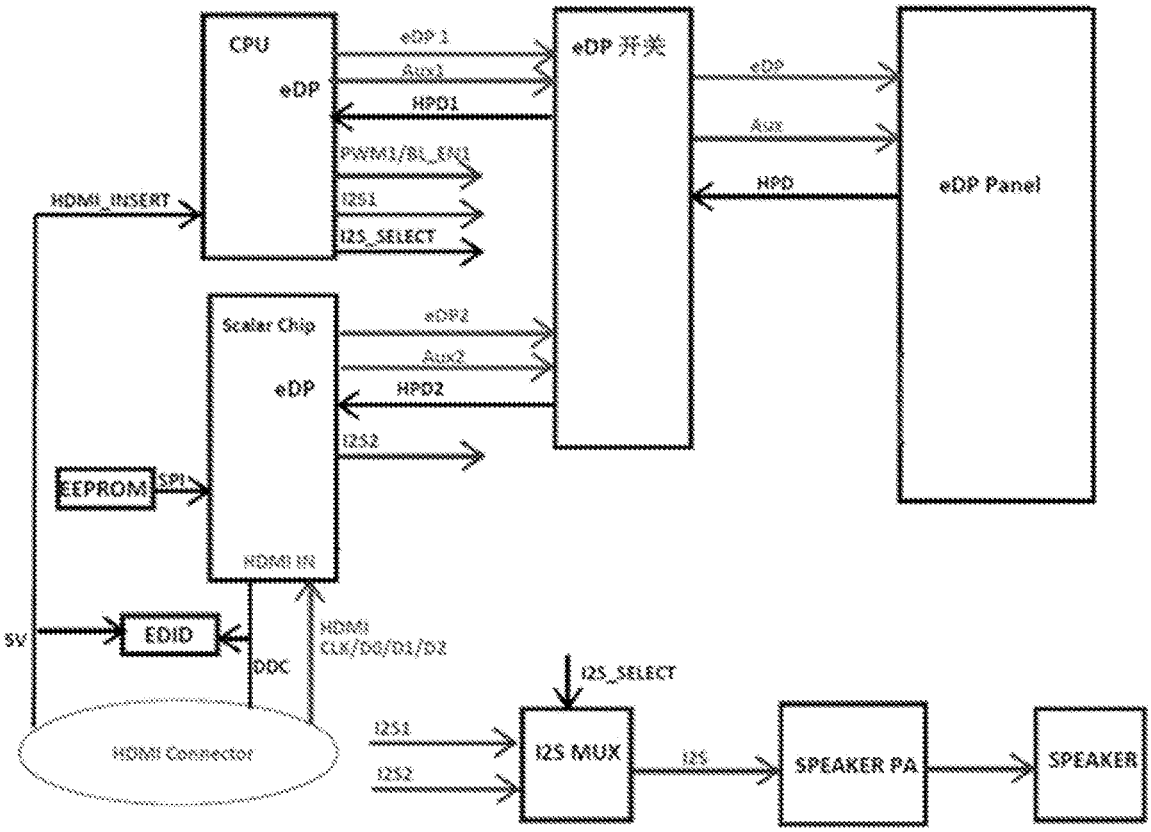
FIG. 6 illustrates a schematic diagram showing a circuit architecture and its signal flow diagram for display control and audio playback control of an apparatus in a parallel manner according to some embodiments of the present disclosure.

For example, as shown in FIG. 6, when the tablet computer is in the host mode, the audio signal is provided by the CPU, such as I2S1 in FIG. 6, and transmitted to the power amplifier assembly SPEAKER PA through the I2S MUX switch chip to perform digital-to-analog conversion and power amplification. After that, SPEAKER PA transmits the processed analog audio signal to SPEAKER for audio playback. When the tablet computer enters the display mode from the host mode, the I2S MUX switch chip disconnects the electrical connection with the CPU, and the CPU enters a low power consumption state such as sleep. After the electrical connection with Scalar Chip is turned on, Scalar Chip obtains the HDMI signal of the external second apparatus through the HDMI interface, so that the display signal is separated and converted to eDP format (eDP2 in FIG. 6). Then, the converted signal is transmitted to the display driver assembly of the eDP panel, and the separated audio signal is transmitted to the SPEAKER PA. The SPEAKER PA performs digital-to-analog conversion and power amplifier process on the separated signal and outputs the analog audio signal to the SPEAKER for audio playback.

In some embodiments, a second switch assembly is added to the first apparatus, and the processor and the controller are connected to the second switch assembly in parallel, so that the processor and the controller may play audio independently in different modes, as such, the controller may be switch to a low power consumption state or even completely power off in the host mode. Since the power consumption of the processor is much lower than the power consumption of the controller, therefore, the purpose for effectively reducing the device power consumption of the first apparatus in host mode may be achieved.

Figure 7:
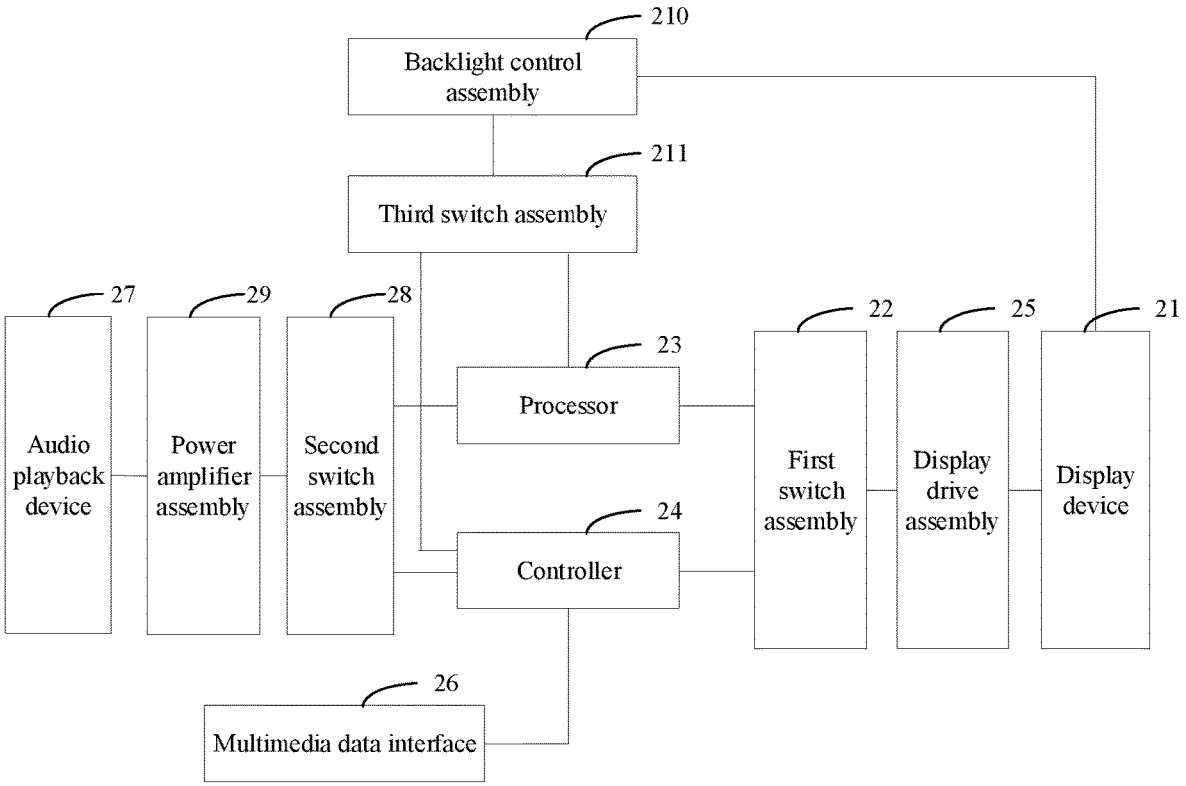
FIG. 7 illustrates another schematic structural diagram of the first apparatus according to some embodiments of the present disclosure.

FIG. 7 is another schematic structural diagram of the electronic apparatus. In some embodiments, as shown in FIG. 7, the first apparatus provided in the present disclosure further includes a backlight control assembly 210 and a third switch assembly 211.

In some embodiments, the backlight control assembly 210 may include the backlight control circuit of the display device 21 of the first apparatus, which is configured to control a backlight brightness of the display device 21.

The third switch assembly 211 is connected to the backlight control assembly 210, the processor 23, and the controller 24, but is not limited to an IO MUX switch chip.

In some embodiments, the third switch assembly 211 is configured to, in response to the first apparatus entering the first mode, turn on the electrical connection between the processor 23 and the backlight control assembly 210, and disconnect the connection between the controller 24 and the backlight control assembly 210.

The third switch assembly 211 is further configured to, in response to the first apparatus entering the second mode, turn on the electrical connection between the controller 24 and the backlight control assembly 210, and disconnect the electrical connection between the processor 23 and the backlight control assembly 210.

In some embodiments, the processor 23 and the controller 24 are connected to the third switch assembly 211 in a parallel manner, and respectively send control signals to the backlight control assembly 210 through the third switch assembly 211, so as to enable the backlight control assembly 210 to control the brightness of the display device 11 in response to the signals.

In some embodiments, the processor 23 may be further configured to detect the backlight control information based on the high power consumption state in the first mode, that is, the host mode. The processor 23 may also be configured to provide the backlight control signal to the backlight control assembly 210 based on the detected backlight control information.

In the host mode, the user may, but is not limited to, operate at the components of the first apparatus configured to trigger the backlight brightness adjustment (such as operating the corresponding brightness adjustment assembly at the touch screen, or the backlight brightness adjustment button of the first apparatus), so that the backlight brightness adjustment signal of the display device 21 is triggered. The processor 23 detects the signal and transmits the adjustment signal to the backlight control assembly 210 through the third switch assembly 211 based on the PWM (Pulse Width Modulation) signal form (for example, based on the PWM signal instructing to increase or decrease the brightness of the backlight by one gear). The backlight control component 210 adjusts its current based on the received PWM signal to achieve the purpose of adjusting the brightness of the backlight of the display device 21.

Figure 8:
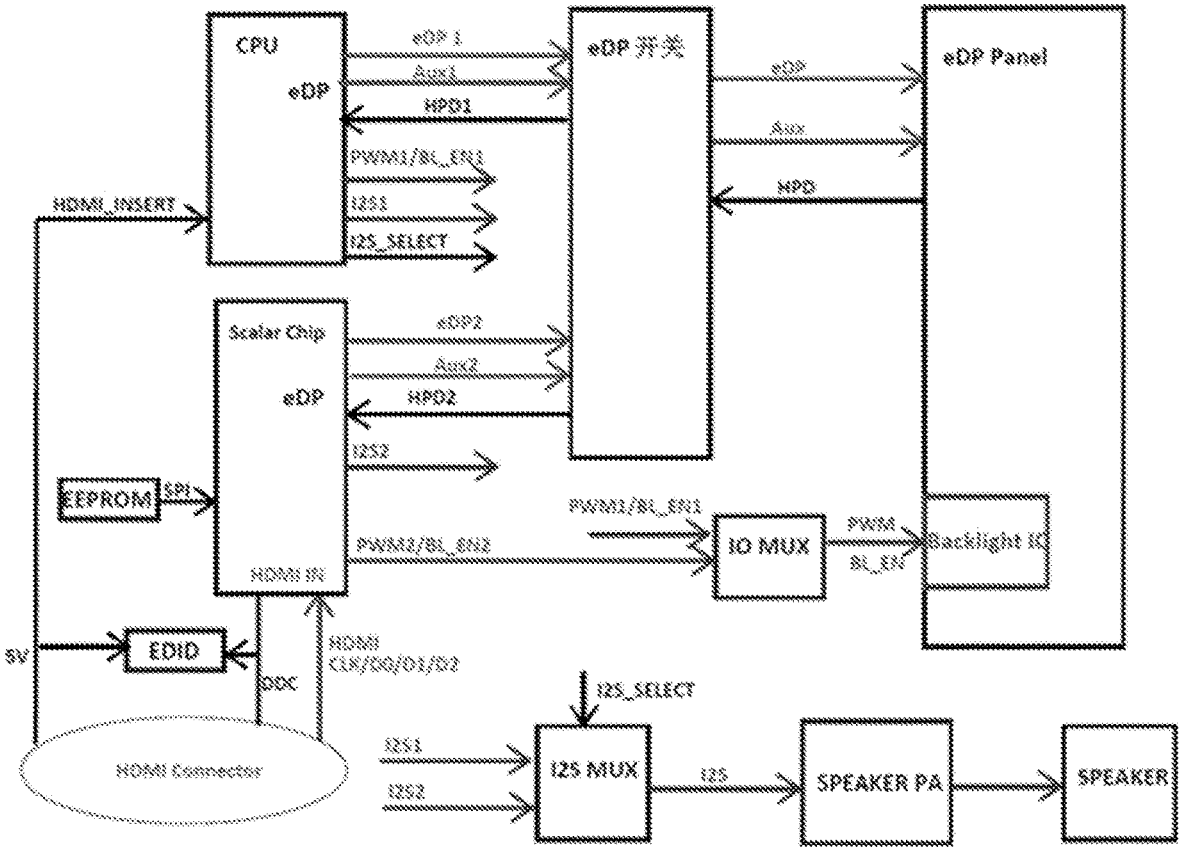
FIG. 8 illustrates a schematic diagram showing a circuit architecture and its signal flow diagram for display control, audio playback control, and backlight brightness control of an apparatus in a parallel manner according to some embodiments of the present disclosure.

For example, as shown in FIG. 8, the CPU transmits the PWM signal generated based on the detected backlight brightness adjustment signal, such as PWM1 in FIG. 8. The PWM1 is transmitted to the backlight control circuit backlight IC of the eDP panel through the IO MUX. The backlight IC adjusts its current based on a received PWM signal to change the backlight brightness of the eDP panel.

The processor 23 may also be configured to, in response to the backlight adjustment operation, switch from the low power consumption state to the high power consumption state in the second mode, that is, the display mode. The processor 23 may be configured to identify the corresponding backlight control information based on the high power consumption state and transmit the identified backlight control information the controller 24.

To match the above-described function of the processor 23, the controller 24 may also be configured to obtain the backlight control information transmitted by the processor 23 in the display mode and provide the backlight control signal to the backlight control assembly 210 based on the obtained.

In the display mode, the processor 23 is in the low power consumption state. When the user operates the assembly for triggering the backlight brightness adjustment of the first apparatus to trigger the backlight brightness adjustment, the assembly will generate an interrupt and notify the processor 23, as such, the processor 23 is awakened and enters the working state (CPU switches from low power consumption to high power consumption state, but still in the display mode). The CPU recognizes the corresponding brightness adjustment information and notifies the brightness adjustment information to the controller 24, and then the processor 23 automatically switches back to the low power consumption state. The controller 24 generates a corresponding PWM signal based on the brightness adjustment information transmitted by the processor 23 and transmits the PWM signal to the backlight control assembly 210 through the third switch assembly 211. The backlight control assembly 210 adjusts its current level based on the received PWM signal to achieve the purpose for adjusting the brightness of the backlight of the display device 21.

As shown in FIG. 8, the scalar chip generates a PWM signal (PWM2 in FIG. 8) based on the backlight brightness adjustment information of the received CPU in the display mode, and the signal is transmitted to the backlight control circuit of the eDP panel through the IO MUX The backlight IC receives the PWM signal and changes the backlight brightness of the eDP panel by adjusting its current.

In some embodiments, a third switch assembly is added to the first apparatus, and the processor and the controller are connected to the third switch assembly in parallel, as such, the processor and the controller are in different modes and independently perform the backlight brightness control on the first apparatus, which can support switching the controller to a low power consumption state or even completely power off in the host mode. Since the power consumption of the processor is much lower than the power consumption of the controller, therefore, the purpose for effectively reducing the device power consumption of the first apparatus in the host mode may be achieved.

In current technology, when an apparatus such as a tablet computer is running in the display mode, display parameters of its display may not be adjusted on the apparatus side. Since the multimedia data interface such as the HDMI interface or DP interface of the apparatus may only transmit multimedia signals (such as audio and video signals), and may not transmit display parameter signals (such as backlight brightness) of the display device, the display screen brightness of the apparatus as an extended display may not be adjusted on the external second apparatus. That is, the brightness of the display screen cannot be adjusted when the apparatus is running in display mode.

According to some embodiments of the present disclosure, when the first apparatus is running in the display mode, an interrupt is triggered based on a backlight brightness adjustment operation, and the processor CPU is temporarily awakened based on the interrupt to identify and transmit the brightness adjustment information (transmit to the controller Scalar chip for display backlight brightness adjustment), which effectively solves the above problems and realizes the adjustment of the brightness of the display screen of the first apparatus configured as an extended display in the display mode. In addition, the processor CPU automatically switches to a low power consumption state after being awakened to recognize and transmit the brightness adjustment information, thereby reducing power consumption as much as possible at the same time.

Various embodiments of the present disclosure are described progressively, and each embodiment focuses on differences from other embodiments. The same or similar parts between the various embodiments may be referred to each other.

To facilitate the description of embodiments, the above-described system or devices are divided into various modules or units by function to be described separately. When implementing the disclosure, the functions of each unit may be implemented in the same or a plurality of software and/or hardware.

From the description of the above-described implementation manners, those skilled in the art may clearly understand that the present disclosure may be implemented by manners of software plus a necessary general hardware platform. As such, the technical solution of the present disclosure essentially or the part that contributes to the existing technology may be embodied in the form of a software product, and the computer software product may be stored in a storage medium, such as ROM/RAM, magnetic disk, CD-ROM, etc., including several instructions to make a computer device (such as a personal computer, a server, or a network device, etc.) execute the methods described in the various embodiments or some parts of the embodiments of the present disclosure.

Finally, the terms such as first, second, third, and fourth are used to distinguish one entity or operation from another entity or operation, and should not be understood to indicate or imply relative importance or implicitly indicate any actual relationship or order between these entities or operations. Moreover, the terms "including," "containing" or any other variants are intended to cover non-exclusive inclusion, so that a process, a method, an article, or a device that includes a series of the element includes not only those elements, but also those elements that are not explicitly listed, or also include elements inherent to the process, the method, the article or the device. If there are no more restrictions, the element defined by the sentence "including a . . . " does not exclude the existence of other identical elements in the process, the method, the article, or the device that includes the element.

The described embodiments are only some embodiments not all the embodiments of the present disclosure. Those of ordinary skill in the art can make various modifications or improvements to embodiments within the scope of the present disclosure.

What is claimed is:

1. An apparatus comprising:

a display device;

a first switch assembly configured to switch a signal source of a display signal for the display device;

a processor connected to the first switch assembly and configured to provide the display signal to the display device through the first switch assembly in a first mode;

a controller connected to the first switch assembly and configured to provide the display signal to the display device through the first switch assembly in a second mode;

an audio playback device; and a second switch assembly connected to the audio playback device, the processor, and the controller.

2. The apparatus of claim 1, wherein:

the controller is configured to obtain the display signal from an external apparatus and provide the display signal to the display device in the second mode;

a power consumption of the controller in the first mode is lower than a power consumption of the controller in the second mode; and a power consumption of the processor in the first mode is higher than a power consumption of the processor in the second mode.

3. The apparatus of claim 1, further comprising:

a multimedia data interface;

wherein the processor is configured to:

control the apparatus to switch to the second mode in response to detecting access information indicating that another apparatus is connected to the multimedia data interface;

control the apparatus to switch to the first mode in response to detecting disconnection information indicating that the another apparatus is disconnected from the multimedia data interface; and detect the disconnection information based on a low power consumption state in the second mode.

4. The apparatus of claim 1, further comprising:

a display drive assembly configured to perform display driving for the display device;

wherein the processor and the controller are connected to the display drive assembly through the first switch assembly.

5. The apparatus of claim 4, wherein the first switch assembly is further connected to the display drive assembly and is further configured to:

in response to the apparatus entering the first mode, turn on an electrical connection between the processor and the display drive assembly, and disconnect an electrical connection between the controller and the display drive assembly; and in response to the apparatus entering the second mode, turn on the electrical connection between the controller and the display drive assembly, and disconnect the electrical connection between the processor and the display drive assembly.

6. The apparatus of claim 1, wherein the second switch assembly is configured to:

in response to the apparatus entering the first mode, turning on an electrical connection between the processor and the audio playback device, and disconnect an electrical connection between the controller and the audio playback device; and in response to the apparatus entering the second mode, turn on the electrical connection between the controller and the audio playback device, and disconnect the electrical connection between the processor and the audio playback device.

7. The apparatus of claim 1, further comprising:

an amplifier assembly connected between the audio playback device and the second switch assembly, and configured to perform digital-to-analog conversion and power amplification on a digital audio signal to generate an amplified analog audio signal and transmit the amplified analog audio signal to the audio playback device for playback.

8. The apparatus of claim 7, wherein:

the processor is further configured to, in the first mode, obtain the digital audio signal and transmit the digital audio signal to the power amplifier assembly through the second switch assembly; and the controller is further configured to, in the second mode, obtain the digital audio signal and transmit the digital audio signal to the power amplifier assembly through the second switch assembly.

9. The apparatus of claim 1, further comprising:

a multimedia data interface;

a display drive assembly configured to perform display driving for the display device; and an amplifier assembly;

wherein the controller is further configured to, in the second mode:

obtain a multimedia data signal transmitted by another apparatus through the multimedia data interface;

separate the multimedia data signal into the display signal and a digital audio signal;

convert the display signal into a converted display signal having a format required by the display device;

provide the converted display signal to the display drive assembly; and provide the digital audio signal to the amplifier assembly.

10. The apparatus of claim 1, further comprising:

a backlight control assembly configured to control a backlight brightness of the display device; and a third switch assembly connected to the backlight control assembly, the processor, and the controller.

11. The apparatus of claim 10, wherein the third switch assembly is configured to:

in response to the apparatus entering the first mode, turn on an electrical connection between the processor and the backlight control assembly, and disconnect an electrical connection between the controller and the backlight control assembly; and in response to the apparatus entering the second mode, turn on the electrical connection between the controller and the backlight control assembly, and disconnect the electrical connection between the processor and backlight control assembly.

12. The apparatus of claim 10, wherein:

the processor is further configured to:

in the first mode, detect backlight control information based on a high power consumption and provide a backlight control signal to the backlight control assembly; and in the second mode, in response to a backlight adjustment operation, switch from a low power consumption state to the high power consumption state, identify the backlight control information based on high power consumption state, and transmit the backlight control information to the controller; and the controller is further configured to obtain the backlight control information transmitted by the processor and provide the backlight control signal to the backlight control assembly based on the backlight control information.

13. The apparatus of claim 1, wherein the processer includes a central processing unit (CPU) of the apparatus, and the controller includes a main control chip of the display device of the apparatus.

14. The apparatus of claim 13, wherein:

the CPU is in a sleep state or a hibernation state in the second mode; and the main control chip is in a sleep state, a hibernation state, or a power-off state in the first mode.

15. An apparatus comprising:

a display device;

a switch assembly configured to switch a signal source of a display signal for the display device;

a processor connected to the switch assembly and configured to provide the display signal to the display device through the switch assembly in a first mode;

a controller connected to the switch assembly and configured to provide the display signal to the display device through the switch assembly in a second mode;

a multimedia data interface;

a display drive assembly configured to perform display driving for the display device; and an amplifier assembly;

wherein the controller is further configured to, in the second mode:

obtain a multimedia data signal transmitted by another apparatus through the multimedia data interface;

separate the multimedia data signal into the display signal and a digital audio signal;

convert the display signal into a converted display signal having a format required by the display device;

provide the converted display signal to the display drive assembly; and provide the digital audio signal to the amplifier assembly.

* * * * *